US005228667A

United States Patent [19]

Bridegum

[11] Patent Number: 5,228,667

[45] Date of Patent: Jul. 20, 1993

[54] FACIA BOARD HOLDER CLAMP

[76] Inventor: James E. Bridegum, 10 De Anza Dr., Reno, Nev. 89511

[21] Appl. No.: 981,528

[22] Filed: Nov. 25, 1992

[51] Int. Cl.[5] ..... B25B 1/20

[52] U.S. Cl. ..... 269/45; 269/97

[58] Field of Search ..... 269/45, 904, 98, 37, 269/41, 43, 82–85, 152–155; 52/702

[56] References Cited

U.S. PATENT DOCUMENTS

| | | | |
|---|---|---|---|
| 1,987,826 | 1/1935 | Heumann | 269/98 |
| 4,300,754 | 11/1981 | Lawrence | 269/34 |
| 5,054,755 | 10/1991 | Hawkes | 269/904 |
| 5,058,869 | 10/1991 | Ruthven | 269/45 |

*Primary Examiner*—Robert C. Watson

[57] ABSTRACT

A combination clamping and holding device is provided for clamping to an eave or a gable outrigger for the purpose of receiving and holding a facia board in position for nailing. The device is held in position by an upper lip while a single spindle is being tightened and it is removed after the facia board is nailed in place by loosening the spindle and then moving the device sideways where the upper lip will clear the facia board, allowing the device to drop downward to clear the facia board.

The facia board holding portion of the device contains both angular and height adjustments so that it may be pre-set prior to clamping it into position, and the outside leg of the holding portion of the device is higher than the inside leg so that a facia board may be slid off of the edges of eaves or outriggers were it will hit a stop and drop into the correct position.

7 Claims, 1 Drawing Sheet

PAGE 1 of 1

FACIA BOARD HOLDER CLAMP

BACKGROUND OF THE INVENTION

This invention relates generally to an improvement in clamps for use by carpenters in home construction. More particularly, this invention relates to an improved clamp with a holding device capable of attaching to various size roof eaves and gable outriggers that will receive and hold facia boards at the correct angles and heights for nailing to these same eaves and outriggers.

While clamps of various types have bene developed over the years for use in many phases of home construction, clamps for holding facia boards have been awkward and difficult to use. Consequently, in practice, two people are still employed to install facia boards; one person nailing on one end, while a second person holds the facia board in position at the other end.

Traditionally, facia boards have been installed by first erecting scaffolding for the carpenters to stand on, but in recent years, in an effort to reduce costs, the practice is usually for carpenters to stand on the eaves, gables, or the frame of a structure and to reach out beyond the end of the eaves or outriggers to nail on the facia boards. With either of these two methods a second person is required to hold the facia board at the correct height and angle for nailing. While this practice has worked, it proves costly, since the second person spends a large portion of his or her time waiting for the other person to measure the board and cut it on a 45 degree angle before it can be held in position and butted against the adjacent facia board for nailing.

The alternative to using two people of course would be to use apparatuses cited in the prior art references, but none of these devices can be pre-set to hold a facia board on the correct angle and all of these devices require the facia board be lifted into the apparatus which cannot be done by a person holding the board at the opposite end.

A need therefore exists for a clamp, that can be attached quickly to an eave or gable outrigger, that will hold the facia board at a pre-set correct angle as well as a pre-set height, and then allow the facia board to easily slid off of the ends of the eaves or outriggers against a stop where it can easily be dropped into the holder by someone moving the board at the opposite end.

The present invention fulfills this need and provides further related advantages.

PRIOR ART REFERENCES

Various devices have been used for holding facia boards or other types of beams during construction, but none reveal or suggest a combination clamping and holding device that will permit a facia board to be slid off of the ends of eaves or rafters where it will hit a stop and drop into a correct pre-set height and angular position. These prior art references are:

| U.S. Pat. No. | Inventor |
|---|---|
| 5,088,682 | Gibbs |
| 4,836,517 | Vossler |
| 4,340,100 | Anderson |
| 4,002,328 | Wolf |
| 3,373,988 | McKelvey |
| 3,092,900 | Smith et al |
| 2,899,145 | Hoffman |

-continued

| U.S. Pat. No. | Inventor |
|---|---|
| 2,686,960 | Leroy |

SUMMARY OF THE INVENTION

In accordance with the invention an improved combination clamp and holding device is provided that can quickly and easily be attached to various size eaves as well as gable outriggers and readily receive and hold facia boards of various sizes at the correct angles and heights for nailing to these same eaves or outriggers.

Another object of the invention is to permit the device to be pre-adjusted for eave pitch as well as the facia board height, and locked into position, so that the carpenter need only place it into position at the end of the eave or outrigger where it can be tightened into position by merely turning a single spindle.

A further object of the invention is to allow the facia boards when cut to be laid on the ends of the eaves or gable outriggers and slid into position by a carpenter working at the opposite end of the facia board.

Another object of the invention is to provide a stop to catch the facia board when it is being slid into position by a person moving the board at the opposite end so it will readily drop into the holding device where it can easily be moved sideways into position for nailing.

A further object of the invention is to provide a device that can easily be removed once the facia board is nailed in place. This is accomplished by merely loosening a single spindle and moving the device sideways where it will drop downward to clear the facia board.

The novel features which are believed to be characteristic of the invention, both as to design and method of use, together with further objects and advantages will be better understood from the following description, considered in conjunction with the accompanying drawings in which the preferred embodiments of the invention are illustrated by way of example. It is expressly understood, however, that the drawings ar for the purpose of illustration and description only and are not intended as a definition of the limits of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
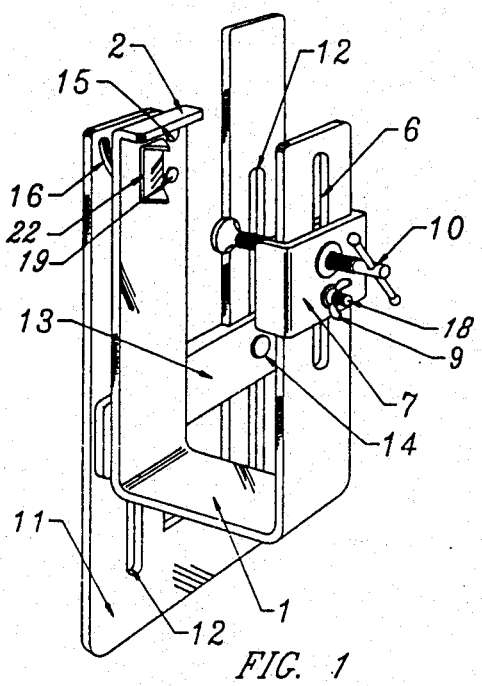
FIGS. 1 and 2 are perspective views of the preferred embodiments of the invention from opposite sides.
Figure 2:
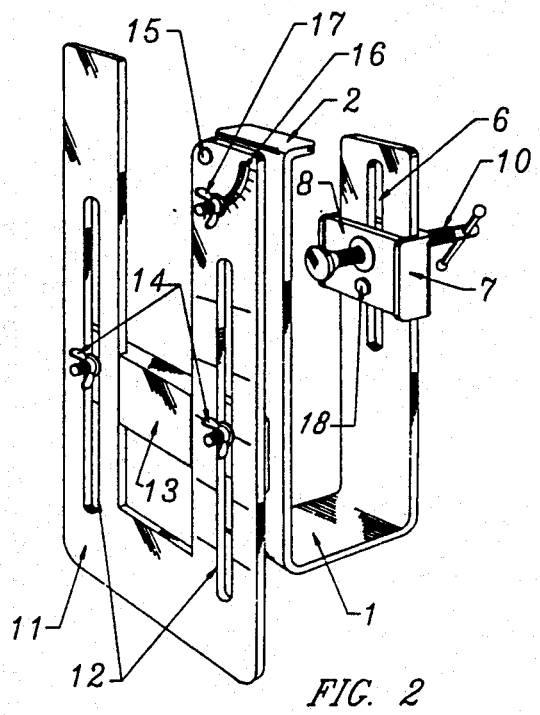
Figure 3:
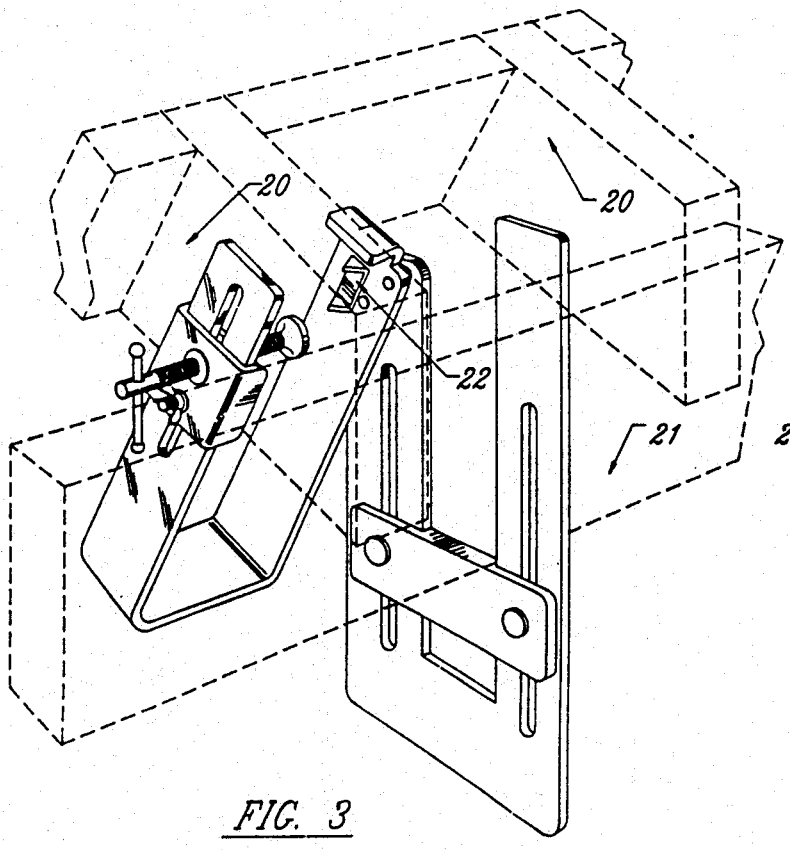
FIG. 3 is a perspective view illustrating the device clamped on to an eave, with a facia board in the holding bracket of the device.
Figure 4:
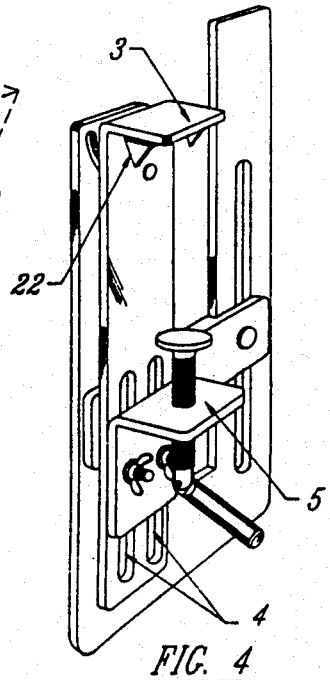
FIG. 4 is a perspective view of an alternative embodiment.

As shown in the exemplary drawings, FIGS. 1, 2, 3, and 4, a clamping and holding device is provided that will clamp on to eaves 20 shown in FIG. 3, or gable outriggers of various widths and heights and hold facia boards 21 depicted in FIG. 3, in various heights and various angular positions. Importantly the device will permit the clamp to be readily removed from the eave or outrigger by loosening the spindle bolt 10 (FIGS. 1 and 2) or 5 (FIG. 4), and moving the device sideways where it will drop downward away from the facia board 21 in FIG. 3.

In the preferred embodiment FIGS. 1 and 2, the clamping pressure is applied to the vertical sides of the boards. In this embodiment the spindle holder 7 may be adjusted upward in the slide 6 to clamp to the smallest height eaves or outriggers, or moved downward for better gripping of larger height facia boards. In the preferred embodiments, FIGS. 1 and 2, once the spindle is positioned correctly, it is locked in place with a wing nut and bolt 9 and 18 which tightens the spindle holding plate against the clamping device outer leg. When the clamping portion of the device is placed onto an eave or outrigger, the upper lip 2 (FIGS. 1 and 2) on the inside leg of the clamping portion of the device 1 (FIGS. 1 and 2) hold the device in place on the eave or outrigger while the spindle 10 is being tightened. In use, this lip will then clear the eave or outrigger and allow the device to drop downward when the spindle 10 is loosened. In an alternative embodiment, FIG. 4, the clamping pressure is applied to the horizontal sides, top and bottom, of the eave or outrigger by tightening the spindle 5 which tightens the board between the spindle and upper lip 3. A side adjustment 4 (FIG. 4) enables this to be accomplished with a minimum size spindle bolt, by first locking the spindle holder in a position where it will just clear the eave or outrigger being clamped.

Importantly in either embodiment pointed teeth 22 (FIGS. 1, 3, and 4) on the side opposite the spindle penetrate the eave or gable outrigger and hold the clamp tightly in position when the spindle is tightened.

The U-shaped facial board holding bracket 11 (FIGS. 1 and 2) is attached to the clamping portion of the device 1 (FIGS. 1 and 2) by a suitable method at the outside corner of the clamping device and inside corner of the U-shaped holding bracket 15 (FIGS. 1 and 2), so that the inside edge of the holding bracket will be flush with the inside edge of the facia board when the facia board drops into position 21 (FIG. 3). In the embodiment shown, the correct angular adjustment is made by loosening the wing nut 17 (FIG. 2) and moving the holding bracket 11 (FIG. 1) into the correct angular position in the slot 16 (FIGS. 1 and 2) and then locking it in place. In the preferred embodiment a scale is provided for these angular adjustments.

When a facia board is moved into position it slides over the top edge of the clamp 2 and the top of the inside portion of the holding bracket 11 (FIGS. 1 and 2) until it meets the inside edge of the outside leg of the holding bracket which acts as a stop. At this point, it will drop into position with a slight twist and come to rest on the height adjustment plate 13 (FIGS. 1 and 2) which is pre-adjusted by the carpenter depending on the height of the facia board. In the preferred embodiment the holding plate 13 (FIGS. 1 and 2) is adjusted upward and downward by loosening the wing nut and bolt assemblies 14 (FIG. 2) and sliding the height adjustment plate in the slides 12 (FIG. 2). In the preferred embodiment a scale is also provided for this purpose. Importantly, this adjustment will accommodate all heights created by the different angular cuts of the eaves, allowing the inside edge of the facia board to always be pre-set to be flush with the top of the eaves.

The foregoing detailed description is illustrative of the embodiments of the invention and it is to be understood that additional embodiments thereof will be obvious to those skilled in the art. The embodiments described herein, together with those additional embodiments are considered to be within the scope of the invention.

What is claimed is:

1. A device for clamping on an eave or outrigger in combination with a holding device for receiving and holding a facia board in position for nailing comprising:

a. A U-shaped device with an upper lip to hold the device in place on an eave or outrigger while a spindle is being tightened;

b. a spindle to tighten and hold the device in place against two opposite vertical sides of an eave or outrigger;

c. a U-shaped bracket attached to the clamping device for the purpose of receiving and holding a facia board wherein said U-shaped bracket may be adjusted to various angles and said U-shaped bracket contains a secondary bracket that adjusts upward or downward to receive and accommodate facia boards of various heights.

2. the device as defined in claim 1, wherein said U-shaped bracket for receiving and holding a facia board has an outside member that extends higher than the inside member and such member acts as a stop when the facia board is slid against said member.

3. The device as defined in claim 1, wherein the vertical side of the clamping portion of the device, opposite the spindle, contains one or more pointed teeth that penetrate the eave or outrigger to help hold the device in position when the spindle is tightened.

4. A device for clamping to an eave or outrigger in combination with a holding device for receiving and holding a facia board in position for nailing comprised of:

a. U-shaped device in which the top leg extends over the top of an eave or outrigger;

b. a spindle for clamping the device in position by tightening the spindle against the bottom side of an eave or outrigger;

c. a U-shaped bracket attached to the clamping device for the purpose of receiving and holding a facia board, wherein said U-shaped bracket may be adjusted to various angles and said U-shaped bracket contains a secondary bracket that adjusts upward or downward to receive and accommodate facia boards of various heights.

5. The device as defined in claim 4, wherein said U-shaped bracket for receiving and holding a facia board contains an outside member that extends higher than the inside member and such member acts as a stop when the facia board is slid against said outside member.

6. A device for clamping to an eave or outrigger in combination with a holding device for receiving and holding a facia board in position for nailing comprised of:

a. a U-shaped device with an upper lip that attaches to an eave or outrigger for the purpose of holding a second bracket;

b. a U-shaped bracket attached to the U-shaped device for the purpose of receiving and holding a facia board in position wherein said U-shaped bracket may be adjusted to various angles and said U-shaped bracket contains a secondary bracket that adjusts upward or downward to accommodate facia boards of various heights.

7. The device as defined in claim 6, wherein said U-shaped bracket for receiving and holding a facia board has an outside member that extends higher than the inside member and such member acts as a stop when the facia board is slid against said outside member.

* * * * *